United States Patent [19]

Chang et al.

[11] 4,314,855

[45] Feb. 9, 1982

[54] METHOD OF CLEANING TEST PROBES

[75] Inventors: Chuan C. Chang, Berkeley Heights; Jitendra Kumar, Bridgewater, both of N.J.

[73] Assignee: Bell Telephone Laboratories, Incorporated, Murray Hill, N.J.

[21] Appl. No.: 104,379

[22] Filed: Dec. 17, 1979

[51] Int. Cl.[3] ..... B08B 3/08; B08B 3/10

[52] U.S. Cl. ..... 134/3; 51/323; 134/6; 134/26; 134/35; 134/41

[58] Field of Search ..... 134/3, 41, 6, 7, 26, 134/28, 35, 42; 51/323

[56] References Cited

U.S. PATENT DOCUMENTS

| | | | |
|---|---|---|---|
| 1,804,331 | 5/1931 | Freund | 134/35 X |
| 2,622,046 | 12/1952 | Bassett | 134/35 X |
| 3,448,055 | 6/1969 | Mickelson et al. | 134/3 X |
| 3,598,741 | 8/1971 | Kanno | 134/3 X |
| 4,014,715 | 3/1977 | Preston | 134/3 X |
| 4,049,471 | 9/1977 | Koontz | 134/3 X |
| 4,198,262 | 4/1980 | Gay | 134/3 X |

*Primary Examiner*—Marc L. Caroff
*Attorney, Agent, or Firm*—Lucian C. Canepa

[57] ABSTRACT

Contaminants that accumulate on test probes utilized to contact aluminum pads on integrated circuit chips cause the probe resistance to become unacceptably high. As disclosed herein, the contaminants (predominantly a mixture of aluminum and aluminum oxide) are substantially removed by immersing the probes in boiling water. Adding small quantities of phosphoric and/or hydrofluoric acids to the water further improves the cleaning action.

5 Claims, No Drawings

METHOD OF CLEANING TEST PROBES

BACKGROUND OF THE INVENTION

This invention relates to a cleaning procedure and, more specifically, to a method of cleaning test probes that are utilized for contacting conductive pads on electronic devices such as integrated circuit chips.

Integrated circuit chips formed on a wafer may each include multiple contact pads. One known technique for testing such integrated circuits utilizes an array of conductive probes mounted in a base member. Such an assembly is commonly called a probe card. The probes are configured to correspond exactly to the arrangement of pads on each chip. In the probe card, electrical connections respectively extend between the probes and terminals to be connected to associated testing equipment. By bringing the probes into electrical contact with the pads, the circuitry embodied in each chip is connected to the associated equipment for testing.

Heretofore, during the course of successively probing integrated circuit chips of the type having aluminum contact pads, it has been observed in practice that the resistance between the probes and the pads becomes in time unacceptably high. This is particularly true if the testing procedure is specified to be carried out at an elevated temperature, say, 85 degrees C.

A typical expedient resorted to for maintaining the probe-to-pad resistance at acceptable levels is to periodically abrade the probe tips against a rough material such as a ceramic or ground glass surface. However, complete reliance on abrasion as a cleaning technique has some disadvantages. For example, exactly reproducible abrasive procedures are difficult to devise. Also, abrading may degrade the planarity of the probe array and, further, may in time mechanically damage the probe tips to the point where they are unusable. In addition, contaminants scraped from the probe tips during abrasion may end up on the shanks of the probes. Moreover, insulating particles from the abrasive surface may adhere to the probes during the cleaning operation. In turn, these contaminants and particles may later become interposed between the probes and the contact pads thereby preventing the establishment of low-resistance paths therebetween.

Another known expedient for cleaning probes involves the use of an etchant solution containing sodium hydroxide. Such an etchant is, however, undesireable because it is highly corrosive. Moreover, sodium is recognized to be one of the worst contaminants for electronic devices and especially for integrated circuits.

Final electrical testing is performed on finished devices in which considerable processing effort has been invested. Even a slight degradation in probe performance can provide incorrect test results. As a consequence, devices that are actually satisfactory may be discarded as being faulty. The economic cost of such erroneous testing is apparent and can be substantial.

In view of the above, efforts have been directed at trying to devise a simple alternative procedure for cleaning test probes utilized to contact aluminum pads on integrated circuit chips. It was recognized that such efforts, if successful, would provide an improved cleaning procedure that would lead to more reliable testing of electronic devices with an attendant reduction in the overall cost of the devices.

SUMMARY OF THE INVENTION

Accordingly, an object of the present invention is an improved procedure for cleaning probes.

Briefly, this and other objects of the present invention are realized in a specific illustrative technique for cleaning test probes that are utilized to contact aluminum pads on integrated circuit chips. The basic cleaning procedure comprises simply immersing the probes in boiling water. To further enhance the cleaning action, it has been found generally advantageous to add small quantities of phosphoric and/or hydrofluoric acids to the water. In a modification of the basic procedure, abrading and boiling are alternated to effect cleaning of the probes.

DETAILED DESCRIPTION

The first step in testing an integrated circuit wafer containing multiple chips is to connect each chip to an associated test system. This is typically accomplished by means of a standard probe card assembly that comprises tiny metal probes that are designed to be respectively placed in contact with conductive pads on each chip. Illustratively, the probes, made, for example, of tungsten wire, taper to about 0.025 millimeters at their ends. The probes are mounted on a printed circuit board that is adapted to be held in a fixed position above a test pedestal which positions the wafer underneath the probes, as is well known in the art (see, for example, "Integrated Circuit Testing," by M. R. Barber and A. Zacharias, *Bell Laboratories Record,* pages 125–130, May 1977).

Herein, for purposes of a specific illustrative example, the probes will be assumed to be made of tungsten. But it should be realized that the principles of the present invention are also applicable to the cleaning of standard test probes made of other materials such as, for example, palladium or copper-beryllium alloys, or gold-plated or rhodium-plated probes.

The principles of the present invention are directed to cleaning test probes that are utilized to establish electrical connections to aluminum contact pads on integrated circuit chips to be tested. In one particular illustrative case, a wafer included 100 chips each comprising a large-scale-integrated microprocessor circuit to be tested. Each chip included 40 aluminum contact pads disposed around the periphery thereof. Testing of the circuits was specified to be done at 85 degrees C.

In practice, without a suitable cleaning procedure for the herein-considered test probe assembly, the probe-to-pad contact resistance of one or more probes becomes unacceptably high after testing about 20 wafers at 85 degrees C. This increase in contact resistance is typically less severe if testing is conducted at room temperature.

Optical investigation of the probes indicated that material becomes attached thereto during lowering of the probes (when the probe tips slide forward after impacting the contact pads) and again during lifting of the probes (when the tips slide backwards). The precise details of how these successive contacting events result in the formation of resistive material on the probes is complex and not entirely understood.

Auger electron spectroscopic analysis of probes indicated that the contaminant material accumulated thereon during testing was predominantly a mixture of elemental aluminum, aluminum oxide and aluminum oxyfluoride. In addition, the accumulated material was determined to include relatively small quantities of oxygen, carbon, silicon, nitrogen, sodium and magnesium compounds.

In accordance with the principles of this invention, applicants discovered that, surprisingly, contaminated test probes of the type specified above could be effectively cleaned simply by immersing them in boiling water. Deionized water is preferred in practice because it is a relatively standard and well characterized substance, but ordinary tap water is usually satisfactory also. Illustratively, the entire probe assembly is boiled in water for approximately 10 minutes. After being dried, probe assemblies cleaned in this manner are substantially devoid of the previously specified contaminant materials and exhibit excellent probe-to-pad contact resistance properties.

Under actual testing conditions, it is advantageous to clean the aforespecified probes in the manner set forth above after probing a maximum of 20 wafers at 85 degrees C. or after probing a maximum of 100 wafers at room temperature.

A complete and definitive theory of the mechanism involved in the aforespecified cleaning action has not been formulated. Nevertheless, a tentative explanation of the mechanism has been postulated by the applicants. Although the validity and scope of the present invention are not dependent on that explanation, it is instructive to set it forth. The primary mechanism for contaminant removal is probably oxidation of elemental aluminum and hydration of aluminum oxide. The hydrated complexes apparently dissolve readily in hot water (in the sense that they can migrate away from the location where they were formed), and the natural agitation of boiling water is almost certainly helpful in facilitating movement of such complexes. In the course of their physical movement, the hydrated complexes of aluminum carry with them or dislodge other contaminants.

Furthermore, applicants have determined that adding relatively small quantities of phosphoric and/or hydrofluoric acids to the aforespecified water bath enhances the cleaning action thereof. In particular, phosphoric acid accelerates the dissolution rates of aluminum and its oxides, and hydrofluoric acid aids in the removal of silicon dioxide and silicon nitride from the test probes. (Both acids have such low vapor pressure at 100 degrees C. that they are not significantly depleted by evaporation from the water.) In accordance with a specific feature of the principles of the present invention, one particularly advantageous solution for cleaning test probes included water having 0.1% by volume phosphoric acid and/or 0.1% by volume hydrofluoric acid. When hydrofluoric acid is utilized, the vessel holding the cleaning solution is advantageously lined with an acid-resistant material such as Teflon synthetic resin polymer. (Teflon is a registered trademark of E. I. DuPont de Nemours and Co.)

Finally, it is to be understood that the above-described procedures are only illustrative of the principles of the present invention. In accordance with these principles, numerous modifications and alternatives may be devised by those skilled in the art without departing from the spirit and scope of the invention. For example, it is sometimes advantageous to combine the herein-described water boiling technique with some degree of abrasion. One illustrative such combination comprises the following cleaning sequence: test 20 wafers, abrade, test 20 wafers, abrade, test 20 wafers, boil as specified hereinabove, . . . (repeat sequence). The precise number of abradings between boilings is determined by the particular operating test conditions such as the degree of aluminum contamination, temperature, humidity, et cetera. This combined procedure has the advantage of longer intervals between boilings, allows some use of simple abrading techniques, and avoids the eventual build-up on the probes of material that cannot be boiled off.

Moreover, in those cases wherein the cleaning of many probe cards is required, it is advantageous to construct an assembly to hold a number of cards in the water bath simultaneously.

We claim:

1. In a method of removing contaminants from electrically conductive test probes that are utilized to contact aluminum pad regions on an integrated circuit chip, the improvement comprising the step of cleaning said probes after multiple such contacts by immersing the probes in boiling water to remove contaminants accumulated during contacting of said aluminum pad regions.

2. A method as in claim 1 wherein said water is deionized and said cleaning step is carried out for about 10 minutes.

3. A method as in claim 2 wherein said cleaning step is carried out in a solution that comprises said water to which 0.1% by volume phosphoric acid and/or 0.1% by volume hydrofluoric acid have been added.

4. In a method of removing contaminants from electrically conductive test probes that are utilized to contact aluminum pad regions on an integrated circuit chip, the improvement comprising the step of cleaning said probes after multiple such contacts by alternately abrading the probes and immersing them in boiling water to remove contaminants accumulated during contacting of said aluminum pad regions.

5. In a method of removing contaminants from electrically conductive test probes that are utilized to contact aluminum pad regions on an integrated circuit chip, the improvement comprising the step of cleaning said probes after multiple contacts of said aluminum pad regions by immersing the probes in a bath consisting only of boiling water.

* * * * *